US006184197B1

(12) United States Patent
Heinzman et al.

(10) Patent No.: US 6,184,197 B1
(45) Date of Patent: Feb. 6, 2001

(54) POLYMERIC COMPOUND COMPRISING ONE OR MORE ACTIVE ALCOHOLS

(75) Inventors: Stephen Wayne Heinzman; Arnaud Pierre Struillou, both of Newcastle upon Tyne (GB)

(73) Assignee: The Procter & Gamble Company, Cincinnati, OH (US)

( * ) Notice: Under 35 U.S.C. 154(b), the term of this patent shall be extended for 0 days.

(21) Appl. No.: 09/254,728

(22) PCT Filed: Sep. 10, 1997

(86) PCT No.: PCT/US97/15983

§ 371 Date: Sep. 1, 1999

§ 102(e) Date: Sep. 1, 1999

(87) PCT Pub. No.: WO98/12236

PCT Pub. Date: Mar. 26, 1998

(30) Foreign Application Priority Data

Sep. 19, 1996 (EP) ..... 96306834
May 16, 1997 (EP) ..... 97303352

(51) Int. Cl.[7] ..... C11D 3/37
(52) U.S. Cl. ..... 510/475
(58) Field of Search ..... 526/263; 510/475

(56) References Cited

U.S. PATENT DOCUMENTS

| | | | | |
|---|---|---|---|---|
| 2,700,027 | | 1/1955 | Bruson | 260/41 |
| 2,910,445 | | 10/1959 | Mock et al. | 260/2.1 |
| 3,106,548 | | 10/1963 | Lavalou | 260/78 |
| 4,418,187 | * | 11/1983 | Muench et al. | 526/259 |
| 5,354,813 | * | 10/1994 | Farooq et al. | 525/326.7 |

* cited by examiner

*Primary Examiner*—John Hardee
(74) *Attorney, Agent, or Firm*—R. S. Echler, Sr.; K. W. Zerby; S. W. Miller

(57) ABSTRACT

The present invention relates to polymers containing at least one nitrogen atom, wherein at least one of the nitrogen atoms is linked to an ester group, said ester group bearing an active alcohol. By the present invention, a delayed release of the active alcohol is provided upon contact of the compound with an aqueous medium.

6 Claims, No Drawings

POLYMERIC COMPOUND COMPRISING ONE OR MORE ACTIVE ALCOHOLS

FIELD OF THE INVENTION

The present invention relates to polymeric compounds comprising one or more active alcohols. More particularly, it relates to amino functional polymeric compounds comprising one or more active alcohols suitable for use in laundry and cleaning products.

BACKGROUND OF THE INVENTION

Cleaning and laundry products are well-known in the art. However, consumer acceptance of cleaning and laundry products is determined not only by the performance achieved with these products but also the aesthetics associated therewith. The perfume components are therefore an important aspect of the successful formulation of such commercial products.

Accordingly, formulation of compounds which provide a delayed release of the perfume over a longer period of time than by the use of the perfume itself have been provided. Disclosure of such compounds may be found in WO 95/04809, WO 95/08976 and pending application EP 95303762.9. The latter describes betaine ester compounds of perfume alcohols which provide release of the perfume components over a long period of time.

The Applicant has now found that polymers containing one or more nitrogen atoms to which an ester function is linked, so as to provide an N-polymeric betaine ester and/or amino ester of an active alcohol, also provide a delayed release of the active alcohol such as a perfume.

Another advantage of the present invention is that the polymeric group provides sufficient stabilisation of the ester function so that the release of the active alcohol upon storage in product is limited, without hindering the release of the active alcohol upon use of the product.

SUMMARY OF THE INVENTION

The present invention relates to a polymer containing at least one nitrogen atoms, wherein at least one of the nitrogen atoms is linked to an ester group of formula:

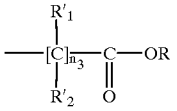

wherein each $R'^1$, $R'_2$, independently, is selected from hydrogen, hydroxyl, alkyl group, alkylene group, aryl group, alkylaryl, or any other chain containing at least 1 carbon atom, wherein $n_3$ is an integer lying in the range from 1 to 3, and wherein R is an organic chain of an active alcohol.

The present invention also encompasses laundry and cleaning compositions incorporating said polymeric compound.

In another aspect of the invention, there is provided a method for providing a delayed release of an active alcohol which comprises the step of contacting materials to be treated with an aqueous medium comprising a compound or composition of the invention.

In a further aspect of the invention, a process is provided for preparing a polymeric ester compound of the invention, by reacting a polyaminofunctional polymer with a bromoacetate and/or chloroacetate of an active alcohol in the presence of a non hydroxylated solvent.

DETAILED DESCRIPTION OF THE INVENTION

Polymeric Compound

The essential component of the invention is a polymer containing at least one nitrogen atom, wherein at least one of the nitrogen atoms is linked to an ester group of formula:

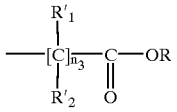

wherein each $R'_1$, $R'_2$, independently, is selected from hydrogen, hydroxyl, alkyl group, alkylene group, aryl group, alkylaryl group, or any other chain containing at least 1 carbon atom, wherein $n_3$ is an integer lying in the range from 1 to 3, preferably $n_3$ is an integer of value 1, and wherein R is an organic chain of an active alcohol.

The different groups for $R'_1$, $R'_2$ can be substituted or unsubstituted.

Preferably, each $R'_1$, $R'_2$, independently, is selected from hydrogen, alkyl group, aryl group, $—(CH_2)_m—COOH$, $—(CH_2)_m—COOR$, $—(CH_2)_{m'}—OH$, $—(CH_2)_{m'}—O(O)CR'$ wherein each m, independently, is an integer of value 0, 1 or 2, and each m', independently, is an integer of value 1, 2 or 3, and R' is an alkyl group containing from 1 to 19 carbons. More preferably, each $R'_1$, $R'_2$ is independently, selected from hydrogen, methyl group, aryl group and most preferably is hydrogen.

Polymers suitable for use herein generally have a molecular weight of less than 100,000, preferably comprised between 300 and 100,000, more preferably between 500 and 10,000, and most preferably between 500 to 5,000. The polymer can be of any type, including copolymer, homopolymers, terpolymer or mixtures of any monomer as long as at least one nitrogen atom is present within the polymer. The nitrogen atom bearing the ester function containing the active alcohol can be located in any position, i.e. in the backbone and/or side chain.

Preferred polymers suitable for use herein are the amino-functional polymers selected from polyamines, polyvinylpyridines, copolymers of poly (vinylpyrrolidone/vinylimidazole), polymers having pyrolidine rings, polyvinylimidazoles, chitosans, and mixtures thereof, preferably polyamine polymers. The polymer may be linear or branched but is preferably branched.

Polyamine polymers suitable for use herein are selected from a)-linear or non-cyclic polyamines having a backbone of the formula:

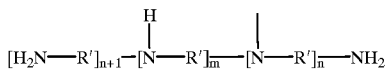

b)-cyclic polyamines having a backbone of the formula:

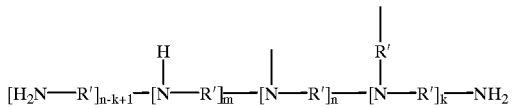

c)-polyamines having a backbone of the formula:

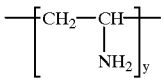

and mixtures thereof;

wherein R' is $C_2$–$C_8$ alkylene, $C_3$–$C_8$ alkyl substituted alkylene, and mixtures thereof; preferably R' is ethylene, 1,2-propylene, 1,3-propylene, and mixtures thereof, more preferably ethylene. R' units serve to connect the amine nitrogens of the backbone; wherein m is from 2 to 700; n is from 0 to 350; y is from 5 to 10,000, preferably from 10 to 5,000, more preferably from 20 to 5,000.

Preferably, the polyamines have a ratio of m:n of at least 1:1 but may include linear polymers (n equal to 0) as well as a range as high as 10:1, preferably the ratio is 2:1. When the ratio of m:n is 2:1, the ratio of primary:secondary:tertiary amine moieties, that is the ratio of —R'$NH_2$, —R'NH, and —R'N moieties, is 1:2:1.

The preferred polyamines for use herein comprise backbones wherein less than 50% of the R' groups comprise more than 3 carbon atoms; more preferably comprise less than 25% moieties having more than 3 carbon atoms, most preferred backbones comprise less than 10% moieties having more than 3 carbon atoms.

The polyamines for use herein comprise homogeneous or non-homogeneous polyamine backbones, preferably homogeneous backbones. For the purpose of the present invention the term "homogeneous polyamine backbone" is defined as a polyamine backbone having R' units that are the same (i.e., all ethylene). However, this sameness definition does not exclude polyamines that comprise other extraneous units comprising the polymer backbone that are present due to an artifact of the chosen method of chemical synthesis. For example, it is known to those skilled in the art that ethanolamine may be used as an "initiator" in the synthesis of polyethyleneimines; therefore, a sample of polyethyleneimine that comprises one hydroxyethyl moiety resulting from the polymerization "initiator" would be considered to comprise a homogeneous polyamine backbone for the purposes of the present invention.

For the purposes of the present invention the term "non-homogeneous polymer backbone" refers to polyamine backbones that are a composite of one or more alkylene or substituted alkylene moieties, for example, ethylene and 1,2-propylene units taken together as R' units.

Other polyamines that comprise the above mentioned backbone are generally polyalkyleneamines (PAA's), polyalkyleneimines (PAI's), preferably polyethyleneamine (PEA's), or polyethyleneimines (PEI's). A common polyalkyleneamine (PAA) is tetrabutylenepentamine. PEA's are obtained by reactions involving ammonia and ethylene dichloride, followed by fractional distillation. The common PEA's obtained are triethylenetetramine (TETA) and tetraethylenepentamine (TEPA). Above the pentamines, i.e., the hexamines, heptamines, octamines and possibly nonamines, the cogenerically derived mixture does not appear to separate by distillation and can include other materials such as cyclic amines and particularly piperazines. Also cyclic amines with side chains in which nitrogen atoms appear can be present. See U.S. Pat. No. 2,792,372, Dickinson, issued May 14, 1957, which describes the preparation of PEA's.

The PEI's which comprise the preferred backbones of the polyamines of the present invention can be prepared, for example, by polymerizing ethyleneimine in the presence of a catalyst such as carbon dioxide, sodium bisulfite, sulfuric acid, hydrogen peroxide, hydrochloric acid, acetic acid, etc. Specific methods for preparing PEI's are disclosed in U.S. Pat. No. 2,182,306, Ulrich et al., issued Dec. 5, 1939; U.S. Pat. No. 3,033,746, Mayle et al., issued May 8, 1962; U.S. Pat. No. 2,208,095, Esselmann et al., issued Jul. 16, 1940; U.S. Pat. No. 2,806,839, Crowther, issued Sep. 17, 1957; and U.S. Pat. No. 2,553,696, Wilson, issued May 21, 1951 (all herein incorporated by reference). In addition to the linear and branched PEI's, the present invention also includes the cyclic amines that are typically formed as artifacts of synthesis. The presence of these materials may be increased or decreased depending on the conditions chosen by the formulator.

Commercially available polyamines suitable for use herein are poly(ethyleneimine) with a MW1200, hydroxyethylated poly(ethyleneimine) from Polysciences, with a MW2000; 80% hydroxyethylated poly(ethyleneimine) from Aldrich; and poly(ethyleneimine) (MW 1800) sold under the tradename Epomin SP-018 by Nippon Shokubai.

Polyvinylimidazoles as well as copolymers of poly (vinylpyrrolidone/vinylimidazole) suitable for use herein are described in DE 2814287. Preferably, the copolymers of poly(vinylpyrrolidone/vinylimidazole) have a molar ratio of N-vinylimidazole to N-vinylpyrrolidone from 1 to 0.2, more preferably from 0.8 to 0.3, most preferably from 0.6 to 0.4. Copolymers of poly (vinylpyrrolidone/vinylimidazole) suitable for use herein are also commercially available from BASF.

Polyvinylpyridines as well as chitosans are commercially available from Aldrich.

The above polymers can also be partially modified. For the purposes of the present invention the term "modification" as it relates to the chemical structure of the polymer is defined as replacing a backbone or side chain —NH hydrogen atom by an R" unit (substitution), quaternizing a backbone nitrogen (quaternized) or oxidizing a backbone nitrogen to the N-oxide (oxidized). The terms "modification" and "substitution" are used interchangably when referring to the process of replacing a hydrogen atom attached to a backbone nitrogen with an R" unit. Alkoxylation or oxidation may take place in some circumstances without substitution, but substitution is preferably accompanied by oxidation or ethoxylation of at least one backbone or side chain nitrogen.

By "partially modified" is meant that at least one NH unit is still present after modification so as to be subsequently linked by chemical reaction to the above mentioned ester function bearing the active alcohol group.

R" units are selected from the group consisting of hydrogen, $C_1$–$C_{22}$ alkyl, $C_3$–$C_{22}$ alkenyl, $C_7$–$C_{22}$ arylalkyl, $C_2$–$C_{22}$ hydroxyalkyl, —$(CH_2)_pCO_2M$, $(CH_2)_qSO_3M$, —$CH(CH_2CO_2M)CO_2M$, —$(CH_2)_pPO_3M$, —$(R^1)$ $O)_xB$, —$C(O)R^3$; wherein $R^1$ is selected from the group consisting of $C_2$–$C_6$ alkylene, $C_3$–$C_6$ alkyl substituted alkylene, and mixtures thereof; $R^3$ is selected from the group consisting of $C_1$–$C_{18}$ alkyl, $C_7$–$C_{12}$ arylalkyl, $C_7$–$C_{12}$ alkyl substituted aryl, $C_6$–$C_{12}$ aryl, and mixtures thereof; B is selected from the group consisting of hydrogen, $C_1$–$C_6$ alkyl, —$(CH_2)_q$ $SO_3M$, —$(CH_2)_pCO_2M$, $(CH_2)_qCHSO_3M)CH_2SO_3M$, —$(CH_2)_q$—$CHSO_2M)CH_2SO_3M$, —$(CH_2)_pPO_3M$, $PO_3M$, and mixtures thereof; M is hydrogen or a water-soluble cation in sufficient amount to satisfy charge balance; X is a water-soluble anion; m has the value from 2 to 700; n has the value from 0 to 350; k is less than or equal to n; p has the value from 1 to 6, q has the value from 0 to 6; r has the value of 0 or 1; w has the value 0 or 1; x has the value from 1 to 100; y has the value from 0 to 100; z has the value 0 or 1. Preferably, x has a value from 1 to 20, more preferably from 1 to 10.

Preferred R" units are selected from the group consisting of $C_1$–$C_{22}$ alkylene, $(R^1O)_xB$, —$C(O)R^3$, —$(CH_2)_pCO_2M$, —$(CH_2)_qSO_3M$, —$CH(CH_2CO_2M)CO_2M$, preferably $C_1$–$C_{22}$ alkylene, —$(R^1O)_xB$, and —$C(O)R^3$ and more preferably —$(R^1)_xB$.

Preferably, $R^1$ is selected from the group consisting of $C_2$–$C_6$ alkylene, $C_3$–$C_6$ alkyl substituted alkylene, and mixtures thereof, more preferably $R^1$ is ethylene.

Preferably, $R^3$ is selected from the group consisting of $C_1$–$C_{12}$ alkyl, $C_7$–$C_{12}$ alkarylene, and mixtures thereof, more preferably $R^3$ is selected from the group consisting of $C_1$–$C_{12}$ alkyl and mixtures thereof, most preferably $R^3$ is selected from the group consisting of $C_1$–$C_6$ alkyl and mixtures thereof. A most preferred group for $R^3$ is methyl.

Preferably, B units are selected from the group consisting of hydrogen, $C_1$–$C_6$ alkyl, —$(CH_2)_qSO_3M$, —$(CH_2)_q(CHSO_3M)CH_2SO_3M$, —$(CH_2)_q(CHSO_2M)$—$CH_2SO_3M$, and mixtures thereof, more preferably B is selected from the group consisting of hydrogen, —$(CH_2)_qSO_3M$, —$(CH_2)_q(CHSO_3M)CH_2SO_3M$, —$(CH_2)_q(CHSO_2M)$—$CH_2SO_3M$, and mixtures thereof, most preferably B is selected from the group consisting of hydrogen, wherein q has the value from 0 to 3.

Among the above described polymers, the more preferred polymer is a branched polyethylenimine of molecular weight between 500 and 5,000, preferably partially ethoxylated with 0.25 to 0.75 mole of ethylene oxide per mole of nitrogen in the polymer.

For the above mentioned compounds, the R group is the organic chain of an active alcohol. By "organic chain" is meant any chain containing at least 1 carbon atom. Preferably, the active alcohol is selected from a flavour alcohol ingredient, a pharmaceutical alcohol active, a biocontrol alcohol agent, a perfume alcohol component and mixtures thereof. When more than one R group are present on the polymeric compound of the invention, each R group can be different from the others, e.g when there are two R groups, one can be a biocontrol alcohol agent and the other a perfume alcohol component, or one R is a perfume alcohol component and the other R group a different perfume alcohol component. Flavour ingredients include spices, flavor enhancers that contribute to the overall flavour perception.

Pharmaceutical actives include drugs.

Biocontrol agents include biocides, antimicrobials, bactericides, fungicides, algaecides, mildewcides, disinfectants, antiseptics, insecticides, vermicides, plant growth hormones.

Perfume alcohol components include components having odoriferous properties.

Preferably, for the above mentioned compounds, the R group is the organic chain of a perfume alcohol, said alcohol being selected from 2-phenoxyethanol, phenylethylalcohol, geraniol, citronellol, 3-methyl-5-phenyl-1-pentanol, 2,4-dimethyl-3-cyclohexene-1-methanol, linalool, tetrahydrolinalool, 1,2-dihydromyrcenol, hydroxycitronellal, farnesol, menthol, isopulegol, eugenol, vanilin, cis-3-hexenol, terpineol and mixtures thereof. Preferred R groups for the purpose of the invention are the organic chains of active alcohol selected from geraniol, citronellol, linalool and dihydromyrcenol.

Preferred polymeric compound for use herein are the polyglycine and/or polybetaine of perfume alcohol. By the term polyglycine is meant that the nitrogen atoms linked to the ester groups of active alcohol are not quaternised; whereas by polybetaine is meant that the nitrogen atoms linked to the ester groups of active alcohol are quaternised.

The nitrogen atom bearing the active alcohol function may also have other substituents on its remaining positions. Preferred substituents are those selected from hydrogen, alkyl, alkylene, aryl group,

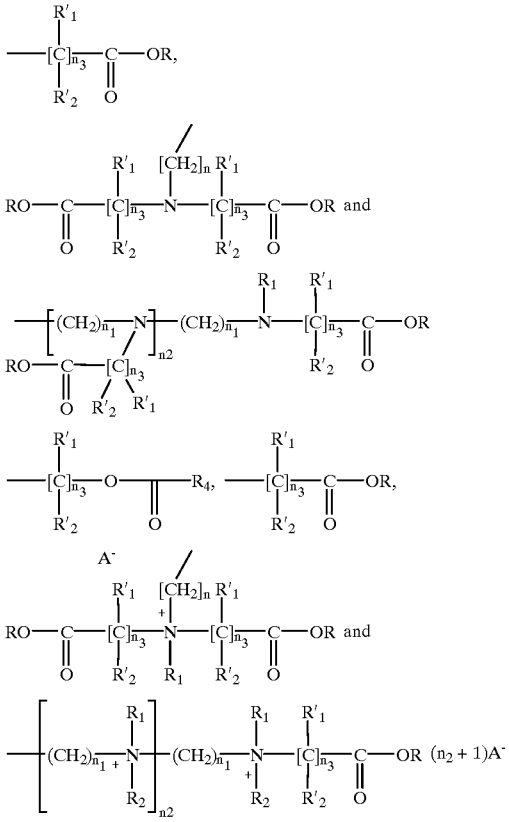

wherein each $R_1$, $R_2$ independently, is selected from hydrogen, alkyl group, aryl group; wherein each n, $n_1$, independently, is an integer lying in the range of from 1 to 20, wherein n2 is an integer lying in the range of 1 to 6, and wherein n3 is as defined above.

For the purpose of the invention, mixtures of the above polymeric compounds comprising one or more active alcohols may also be used.

Mechanism of Release

By the present invention, a delayed release of an active alcohol is obtained. Not to be bound by theory, the release is believed to occur by the following mechanism:

where the nitrogen atom is in a protonated form so as to form a betaine ester, the release of the active alcohol is obtained by hydrolysis of the betaine ester such as upon contact with water or ambient humidity;

where the nitrogen bearing the ester of an active alcohol is in an unprotonated form, the nitrogen atom converts to a protonated form upon a pH drop so as to convert into a betaine and then provides a release of the active alcohol. The pH drop may occur, for example, by dilution of the compound in water.

Accordingly, when the polymeric compound contains both protonated nitrogen atoms bearing the ester of an active alcohol and unprotonated nitrogen atoms bearing the ester of an active alcohol, such as that occurs when the polymeric is a partially quarternised polymer, different delayed rate of release may be obtained: the betaine releasing first its active alcohol while the amino acid releasing its active alcohol only after conversion into its betaine form.

Process

Preparation of the component is made as follows in the Synthesis Examples.

A preferred process for preparing the polymeric compounds comprising one or more active alcohol is by reacting an amino-functional polymer such as a polyamine component with a bromoacetate and/or chloroacetate of an active alcohol in the presence of a non hydroxylated solvent such as chloroform, acetonitrile, acetone, ethyl acetate, or mixtures thereof, preferably chloroform and/or ethyl acetate. One advantage of the present process is that transamidation and/or even transesterification when the polymeric compound is partially ethoxylated is limited. Indeed, transesterification/transamidation is one of the problem which occurs during preparation of the polymeric compounds of the invention. Such a transesterification/transamidation leads to the breakdown of some perfume alcohol ester bonds and to the subsequent liberation of free perfume alcohol during the course of the reaction process. Accordingly, by using a non-hydroxylated solvent, the extent to which these side reactions occur are limited. For example, when using the present process, by reacting polyethyleneimine MW1800, ethoxylated with 0.5 mole of ethylene oxide, and geranyl bromoacetate in chloroform, the transesterification is limited to less than 20%, preferably less than 10% by mole of the starting material geranyl bromoacetate.

It will also be apparent to the skilled person in the art that when a PEI is reacted with a bromoacetate of an active alcohol only transamidation is seen as a side reaction.

Another process, which can be suitable for use herein, for preparing the polymeric compounds of the invention is to first prepare a polyamino methyl ester or a polyamino ethyl ester. The polyamino methyl ester or polyamino ethyl ester can be prepared by reacting a bromo ester or a chloro ester (such as methyl bromoacetate or methyl chloroacetate, methyl bromopropanoate or methyl chloropropanoate) with a polyamino-functional polymer. In a second step, this polyamino methyl ester (such as polyglycine methyl ester or polybetaine methyl ester) or polyamino ethyl ester is transesterified with an active alcohol (such as a perfume alcohol) in the presence of a catalytic to stoechiometric amount of sodium methoxide or sodium. For example, a polyglycine ester of geraniol can be prepared by reacting first methyl chloroacetate with a polyethylenimine and then transesterifying the intermediate polyglycine methyl ester with geraniol, using a catalytic amount of sodium methoxide.

Laundry and Cleaning Compositions

The present invention compositions include both laundry and cleaning compositions which are typically used for laundering fabrics and cleaning hard surfaces such as dishware, floors, bathrooms, toilet, kitchen and other surfaces in need of cleaning and/or disinfecting but also for use in personal cleansing such as shower gels, deodorants, bars, shampoos.

Preferred are those laundry compositions which result in contacting the polymeric ester compound of the invention with fabric. Preferably, for use in such laundry and cleaning products, the active alcohol is a perfume such as geraniol.

These are to be understood to include not only detergent compositions which provide fabric cleaning benefits, but also compositions such as rinse added fabric softener compositions and dryer added compositions (e.g. sheets) which provide softening and/or antistatic benefits as well as hard surface cleaning.

The polymeric ester compound(s) typically comprise from 0.01% to 10%, preferably from 0.05% to 5%, and more preferably from 0.1% to 2%, by weight of the composition. Mixtures of polymeric ester compounds may also be used herein.

Optional ingredients useful for formulating such laundry and cleaning compositions according to the present invention include one or more of the following.

Fabric Softening Agents

A fabric softener component may also suitably be used in the laundry and cleaning compositions of the invention so as to provide softness and antistastic properties to the treated fabrics. When used, the fabric softener component will typically be present at a level sufficient to provide softening and antistatic properties.

Said fabric softening component may be selected from cationic, nonionic, amphoteric or anionic fabric softening component.

The preferred, typical cationic fabric softening components include the water-insoluble quaternary-ammonium fabric softening actives, the most commonly used having been di-long alkyl chain ammonium chloride or methyl sulfate.

Preferred cationic softeners among these include the following:

1) ditallow dimethylammonium chloride (DTDMAC);
2) dihydrogenated tallow dimethylammonium chloride;
3) dihydrogenated tallow dimethylammonium methylsulfate;
4) distearyl dimethylammonium chloride;
5) dioleyl dimethylammonium chloride;
6) dipalmityl hydroxyethyl methylammonium chloride;
7) stearyl benzyl dimethylammonium chloride;
8) tallow trimethylammonium chloride;
9) hydrogenated tallow trimethylammonium chloride;
10) $C_{12-14}$ alkyl hydroxyethyl dimethylammonium chloride;
11) $C_{12-18}$ alkyl dihydroxyethyl methylammonium chloride;
12) di(stearoyloxyethyl) dimethylammonium chloride (DSOEDMAC);
13) di(tallowoyloxyethyl) dimethylammonium chloride;
14) ditallow imidazolinium methylsulfate;
15) 1–(2-tallowylamidoethyl)-2-tallowyl imidazolinium methylsulfate.

However, in recent years, the need has arisen for more environmental-friendly materials, and rapidly biodegradable quaternary ammonium compounds have been presented as alternatives to the traditionally used di-long alkyl chain ammonium chlorides and methyl sulfates. Said materials and fabric softening compositions containing them are disclosed in numerous publications such as EP-A-0,040,562, and EP-A-0,239,910.

The quaternary ammonium compounds and amine precursors herein have the formula (I) or (II), below:

(I)

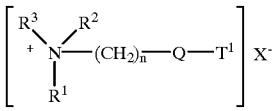

or (II)

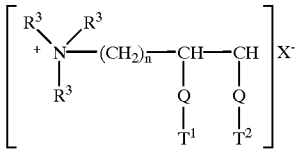

wherein

Q is selected from —O—C(O)—, —C(O)—O—, —O—C(O)—O—, —$NR^4$—C(O)—, —C(O)—$NR^4$—;

$R^1$ is $(CH_2)_n$—Q—$T^2$ or $T^3$;

$R^2$ is $(CH_2)_m$—Q—$T^4$ or $T^5$ or $R^3$;

$R^3$ is $C_1$–$C_4$ alkyl or $C_1$–$C_4$ hydroxyalkyl or H;

$R^4$ is H or $C_1$–$C_4$ alkyl or $C_1$–$C_4$ hydroxyalkyl;

$T^1$, $T^2$, $T^3$, $T^4$, $T^5$ are independently $C_{11}$–$C_{22}$ alkyl or alkenyl;

n and m are integers from 1 to 4; and

X− is a softener-compatible anion.

Non-limiting examples of softener-compatible anions include chloride or methyl sulfate.

The alkyl, or alkenyl, chain $T^1$, $T^2$, $T^3$, $T^4$, $T^5$ must contain at least 11 carbon atoms, preferably at least 16 carbon atoms. The chain may be straight or branched.

Tallow is a convenient and inexpensive source of long chain alkyl and alkenyl material. The compounds wherein $T^1$, $T^2$, $T^3$, $T^4$, $T^5$ represent the mixture of long chain materials typical for tallow are particularly preferred.

Specific examples of quaternary ammonium compounds suitable for use in the aqueous fabric softening compositions herein include:

1) N,N-di(tallowyl-oxy-ethyl)-N,N-dimethyl ammonium chloride;
2) N,N-di(tallowyl-oxy-ethyl)-N-methyl, N-(2-hydroxyethyl) ammonium methyl sulfate;
3) N,N-di(2-tallowyl-oxy-2-oxo-ethyl)-N,N-dimethyl ammonium chloride;
4) N,N-di(2-tallowyl-oxy-ethylcarbonyl-oxy-ethyl)-N,N-dimethyl ammonium chloride;
5) N-(2-tallowyl-oxy-2-ethyl)-N-(2-tallowyl-oxy-2-oxo-ethyl)-N,N-dimethyl ammonium chloride;
6) N,N,N-tri(tallowyl-oxy-ethyl)-N-methyl ammonium chloride;
7) N-(2-tallowyl-oxy-2-oxo-ethyl)-N-(tallowyl-N,N-dimethyl-ammonium chloride; and
8) 1,2-ditallowyl-oxy-3-trimethylammoniopropane chloride; and mixtures of any of the above materials.

Of these, compounds 1-7 are examples of compounds of Formula (1); compound 8 is a compound of Formula (II).

Particularly preferred is N,N-di(tallowyl-oxy-ethyl)-N,N-dimethyl ammonium chloride, where the tallow chains are at least partially unsaturated.

The level of unsaturation of the tallow chain can be measured by the Iodine Value (IV) of the corresponding fatty acid, which in the present case should preferably be in the range of from 5 to 100 with two categories of compounds being distinguished, having a IV below or above 25.

Indeed, for compounds of Formula (I) made from tallow fatty acids having a IV of from 5 to 25, preferably 15 to 20, it has been found that a cis/trans isomer weight ratio greater than 30/70, preferably greater than 50/50 and more preferably greater than 70/30 provides optimal concentrability.

For compounds of Formula (I) made from tallow fatty acids having a IV of above 25, the ratio of cis to trans isomers has been found to be less critical unless very high concentrations are needed.

Other examples of suitable quaternary ammoniums of Formula (I) and (II) are obtained by, e.g.:

replacing "tallow" in the above compounds with, for example, coco, palm, lauryl, oleyl, ricinoleyl, stearyl, palmityl, or the like, said fatty acyl chains being either fully saturated, or preferably at least partly unsaturated;

replacing "methyl" in the above compounds with ethyl, ethoxy, propyl, propoxy, isopropyl, butyl, isobutyl or t-butyl;

replacing "chloride" in the above compounds with bromide, methylsulfate, formate, sulfate, nitrate, and the like.

In fact, the anion is merely present as a counterion of the positively charged quaternary ammonium compounds. The nature of the counterion is not critical at all to the practice of the present invention. The scope of this invention is not considered limited to any particular anion.

By "amine precursors thereof" is meant the secondary or tertiary amines corresponding to the above quaternary ammonium compounds, said amines being substantially protonated in the present compositions due to the pH values.

Additional fabric softening materials may be used in addition or alternatively to the cationic fabric softener. These may be selected from nonionic, amphoteric or anionic fabric softening material. Disclosure of such materials may be found in U.S. Pat. Nos. 4,327,133; 4,421,792; 4,426,299; 4,460,485; 3,644,203; 4,661,269; 4,439,335; 3,861,870; 4,308,151; 3,886,075; 4,233,164; 4,401,578; 3,974,076; 4,237,016 and EP 472,178.

Typically, such nonionic fabric softener materials have an HLB of from 2 to 9, more typically from 3 to 7. Such nonionic fabric softener materials tend to be readily dispersed either by themselves, or when combined with other materials such as single-long-chain alkyl cationic surfactant described in detail hereinafter. Dispersibility can be improved by using more single-long-chain alkyl cationic surfactant, mixture with other materials as set forth hereinafter, use of hotter water, and/or more agitation. In general, the materials selected should be relatively crystalline, higher melting, (e.g. >40° C.) and relatively water-insoluble.

Preferred nonionic softeners are fatty acid partial esters of polyhydric alcohols, or anhydrides thereof, wherein the alcohol, or anhydride, contains from 2 to 18, preferably from 2 to 8, carbon atoms, and each fatty acid moiety contains from 12 to 30, preferably from 16 to 20, carbon atoms. Typically, such softeners contain from one to 3, preferably 2 fatty acid groups per molecule.

The polyhydric alcohol portion of the ester can be ethylene glycol, glycerol, poly (e.g., di-, tri-, tetra, penta-, and/or hexa-) glycerol, xylitol, sucrose, erythritol, pentaerythritol, sorbitol or sorbitan. Sorbitan esters and polyglycerol monostearate are particularly preferred.

The fatty acid portion of the ester is normally derived from fatty acids having from 12 to 30, preferably from 16 to 20, carbon atoms, typical examples of said fatty acids being lauric acid, myristic acid, palmitic acid, stearic acid and behenic acid. Highly preferred optional nonionic softening agents for use in the present invention are the sorbitan esters, which are esterified dehydration products of sorbitol, and the glycerol esters.

Commercial sorbitan monostearate is a suitable material. Mixtures of sorbitan stearate and sorbitan palmitate having stearate/palmitate weight ratios varying between 10:1 and 1:10, and 1,5-sorbitan esters are also useful.

Glycerol and polyglycerol esters, especially glycerol, diglycerol, triglycerol, and polyglycerol mono- and/or di-esters, preferably mono-, are preferred herein (e.g. polyglycerol monostearate with a trade name of Radiasurf 7248).

Useful glycerol and polyglycerol esters include mono-esters with stearic, oleic, palmitic, lauric, isostearic, myristic, and/or behenic acids and the diesters of stearic, oleic, palmitic, lauric, isostearic, behenic, and/or myristic acids. It is understood that the typical mono-ester contains some di- and tri-ester, etc.

The "glycerol esters" also include the polyglycerol,. e.g., diglycerol through octaglycerol esters. The polyglycerol polyols are formed by condensing glycerin or epichlorohydrin together to link the glycerol moieties via ether linkages. The mono- and/or diesters of the polyglycerol polyols are preferred, the fatty acyl groups typically being those described hereinbefore for the sorbitan and glycerol esters.

Further fabric softening components suitable for use herein are the softening clays, such as the low ion-exchange-capacity ones described in EP-A-0,150,531.

For the preceding fabric softening agents, especially with biodegradable fabric softening agents, the pH of the liquid compositions herein is an essential parameter of the present invention. Indeed, it influences the stability of the quaternary ammonium or amine precursors compounds, especially in prolonged storage conditions. The pH, as defined in the present context, is measured in the neat compositions at 20° C. For optimum hydrolytic stability of these compositions, the neat pH, measured in the above-mentioned conditions, must be in the range of from 2.0 to 4.5. Preferably, where the liquid fabric softening compositions of the invention are in a concentrated form, the pH of the neat composition is in the range of 2.0 to 3.5, while if it is in a diluted form, the pH of the neat composition is in the range of 2.0 to 3.0. The pH of these compositions herein can be regulated by the addition of a Bronsted acid.

Examples of suitable acids include the inorganic mineral acids, carboxylic acids, in particular the low molecular weight ($C_1$–$C_5$) carboxylic acids, and alkylsulfonic acids. Suitable inorganic acids include HCl, $H_2SO_4$, $HNO_3$ and $H_3PO_4$. Suitable organic acids include formic, acetic, citric, methylsulfonic and ethylsulfonic acid. Preferred acids are citric, hydrochloric, phosphoric, formic, methylsulfonic acid, and benzoic acids.

The fabric softener compounds herein are present at levels of from 1% to 80% of compositions herein, depending on the composition execution which can be dilute with a preferred level of active from 5% to 15%, or concentrated, with a preferred level of active from 15% to 50%, most preferably 15% to 35% by weight of the composition.

Fully formulated fabric softening compositions preferably contain, in addition to the hereinbefore described components, one or more of the following ingredients.

Enzymes

The composition herein can optionally employ one or more enzymes such as lipases, proteases, cellulase, amylases and peroxidases. A preferred enzyme for use herein is a cellulase enzyme. Indeed, this type of enzyme will further provide a color care benefit to the treated fabric. Cellulases usable herein include both bacterial and fungal types, preferably having a pH optimum between 5 and 9.5. U.S. Pat. No. 4,435,307, Barbesgoard et al, Mar. 6, 1984, discloses suitable fungal cellulases from Humicola insolens or Humicola strain DSM1800 or a cellulase 212-producing fungus belonging to the genus Aeromonas, and cellulase extracted from the hepatopancreas of a marine mollusk, Dolabella Auricula Solander. Suitable cellulases are also disclosed in GB-A-2.075.028; GB-A-2.095.275 and DE-OS-2.247.832. CAREZYME® and CELLUZYMES® (Novo) are especially useful. Other suitable cellulases are also disclosed in WO 91/17243 to Novo, WO 96/34092, WO 96/34945 and EP-A-0,739,982.

In practical terms for current commercial preparations, typical amounts are up to about 5 mg by weight, more typically 0.01 mg to 3 mg, of active enzyme per gram of the composition. Stated otherwise, the compositions herein will typically comprise from 0.001% to 5%, preferably 0.01%–1% by weight of a commercial enzyme preparation. In the particular cases where activity of the enzyme preparation can be defined otherwise such as with cellulases, corresponding activity units are preferred (e.g. CEVU or cellulase Equivalent Viscosity Units). For instance, the compositions of the present invention can contain cellulase enzymes at a level equivalent to an activity from about 0.5 to 1000 CEVU/gram of composition. Cellulase enzyme preparations used for the purpose of formulating the compositions of this invention typically have an activity comprised between 1,000 and 10,000 CEVU/gram in liquid form, around 1,000 CEVU/gram in solid form.

Concentrated compositions of the present invention may require organic and/or inorganic concentration aids to go to even higher concentrations and/or to meet higher stability standards depending on the other ingredients. Surfactant concentration aids are typically selected from the group consisting of single long chain alkyl cationic surfactants; nonionic surfactants; amine oxides; fatty acids; or mixtures thereof, typically used at a level of from 0 to 15% of the composition.

Inorganic viscosity control agents which can also act like or augment the effect of the surfactant concentration aids, include water-soluble, ionizable salts which can also optionally be incorporated into the compositions of the present invention. A wide variety of ionizable salts can be used. Examples of suitable salts are the halides of the Group IA and IIA metals of the Periodic Table of the Elements, e.g., calcium chloride, magnesium chloride, sodium chloride, potassium bromide, and lithium chloride. The ionizable salts are particularly useful during the process of mixing the ingredients to make the compositions herein, and later to obtain the desired viscosity. The amount of ionizable salts used depends on the amount of active ingredients used in the compositions and can be adjusted according to the desires of the formulator. Typical levels of salts used to control the composition viscosity are from 20 to 20,000 parts per million (ppm), preferably from 20 to 11,000 ppm, by weight of the composition. Alkylene polyammonium salts can be incorporated into the composition to give viscosity control in addition to or in place of the water-soluble, ionizable salts above. In addition, these agents can act as scavengers, forming ion pairs with anionic detergent carried over from the main wash, in the rinse, and on the fabrics, and may improve softness performance. These agents may stabilize the viscosity over a broader range of temperature, especially at low temperatures, compared to the inorganic electrolytes.

Specific examples of alkylene polyammonium salts include I-lysine monohydrochloride and 1,5-diammonium 2-methyl pentane dihydrochloride.

Another optional, but preferred, ingredient is a liquid carrier. The liquid carrier employed in the instant compositions is preferably at least primarily water due to its low cost, relative availability, safety, and environmental compatibility. The level of water in the liquid carrier is preferably at least 50%, most preferably at least 60%, by weight of the carrier. Mixtures of water and low molecular weight, e.g., <200, organic solvent, e.g., lower alcohols such as ethanol, propanol, isopropanol or butanol are useful as the carrier liquid. Low molecular weight alcohols include monohydric, dihydric (glycol, etc.) trihydric (glycerol, etc.), and higher polyhydric (polyols) alcohols.

Still other optional ingredients are Soil Release Polymers, bacteriocides, colorants, perfumes, preservatives, optical brighteners, anti ionisation agents, antifoam agents, and the like.

Various other optional adjunct ingredients may also be used to provide fully-formulated detergent compositions. The following ingredients are described for the convenience of the formulator, but are not intended to be limiting thereof.

Detersive Surfactants

Non-limiting examples of surfactants useful herein typically at levels from 1% to 55%, by weight, include the conventional $C_{11}$–$C_1$l alkyl benzene sulfonates ("LAS") and primary, branched-chain and random $C_{10}$–$C_{20}$ alkyl sulfates ("AS"), the $C_{10}$–$C_{18}$ secondary (2,3) alkyl sulfates of the formula $CH_3(CH_2)_x(CHOSO_3\text{-}M^+)$ $CH_3$ and $CH_3(CH_2)_y(CHOSO_3^-M^+)$ $CH_2CH_3$ where x and (y+1) are integers of at least 7, preferably at least 9, and M is a water-solubilizing cation, especially sodium, unsaturated sulfates such as oleyl sulfate, the $C_{10}$–$C_{18}$ alkyl alkoxy sulfates ("$AE_xS$"; especially x up to 7 EO ethoxy sulfates), $C_{10}$–$C_{18}$ alkyl alkoxy carboxylates (especially the EO 1–5 ethoxycarboxylates), the $C_{10-18}$ glycerol ethers, the $C_{10}$–$C_{18}$ alkyl polyglycosides and their corresponding sulfated polyglycosides, and $C_{12}$–$C_1$ g alpha-sulfonated fatty acid esters. If desired, the conventional nonionic and amphoteric surfactants such as the $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, cationic surfactants and the like, can also be included in the overall compositions. The $C_{10}$–$C_{18}$ N-alkyl polyhydroxy fatty acid amides can also be used. Typical examples include the $C_{12}$–$C_{18}$ N-methylglucamides. See WO 9,206,154. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing. $C_{10}$–$C_{20}$ conventional soaps may also be used. If high sudsing is desired, the branched-chain $C_{10}$–$C_{16}$ soaps may be used. Mixtures of anionic and nonionic surfactants are especially useful. Other conventional useful surfactants are listed in standard texts.

Builders

Detergent builders can optionally be included in the compositions herein to assist in controlling mineral hardness. Inorganic as well as organic builders can be used. Builders are typically used in fabric laundering compositions to assist in the removal of particulate soils.

The level of builder can vary widely depending upon the end use of the composition and its desired physical form. When present, the compositions will typically comprise at least 1% builder, preferably from 1% to 80%. Liquid formulations typically comprise from 5% to 50%, more typically 5% to 30%, by weight, of detergent builder. Granular formulations typically comprise from 1% to 80%, more typically from 5% to 50% by weight, of the detergent builder. Lower or higher levels of builder, however, are not meant to be excluded.

Inorganic or P-containing detergent builders include, but are not limited to, the alkali metal, ammonium and alkanolammonium salts of polyphosphates (exemplified by the tripolyphosphates, pyrophosphates, and glassy polymeric meta-phosphates), phosphonates, phytic acid, silicates, carbonates (including bicarbonates and sesquicarbonates), sulphates, and aluminosilicates. However, non-phosphate builders are required in some locales. Importantly, the compositions herein function surprisingly well even in the presence of the so-called "weak" builders (as compared with phosphates) such as citrate, or in the so-called "underbuilt" situation that may occur with zeolite or layered silicate builders.

Examples of silicate builders are the alkali metal silicates, particularly those having a $SiO_2$:$Na_2O$ ratio in the range 1.0:1 to 3.2:1 and layered silicates, such as the layered sodium silicates described in U.S. Pat. No. 4,664,839. NaSKS-6 is the trademark for a crystalline layered silicate marketed by Hoechst (commonly abbreviated herein as "SKS-6"). Unlike zeolite builders, the Na SKS-6 silicate builder does not contain aluminum. NaSKS-6 has the delta-$Na_2SiO_5$ morphology form of layered silicate. It can be prepared by methods such as those described in German DE-A-3,417,649 and DE-A-3,742,043. SKS-6 is a highly preferred layered silicate for use herein, but other such layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0 can be used herein. Various other layered silicates from Hoechst include NaSKS-5, NaSKS-7 and NaSKS-11, as the alpha, beta and gamma forms. As noted above, the delta-$Na_2SiO_5$ (NaSKS-6 form) is most preferred for use herein. Other silicates may also be useful such as for example magnesium silicate, which can serve as a crispening agent in granular formulations, as a stabilizing agent for oxygen bleaches, and as a component of suds control systems. Examples of carbonate builders are the alkaline earth and alkali metal carbonates as disclosed in German Patent Application No.2,321,001 published on Nov. 15, 1973.

Aluminosilicate builders are useful in the present invention. Aluminosilicate builders are of great importance in most currently marketed heavy duty granular detergent compositions, and can also be a significant builder ingredient in liquid detergent formulations. Aluminosilicate builders include those having the empirical formula:

$$M_{z/n}[(AlO_2)_z(SiO_2)_y].xH_2O$$

wherein z and y are integers usually of at least 6, the molar ratio of z to y is in the range from 1.0 to 0, and x is an integer from 0 to 264, and M is a Group IA or IIA element, e.g., Na, K, Mg, Ca with valence n.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel, et al, issued Oct. 12, 1976. Preferred synthetic crystalline aluminosilicate ion exchange materials useful herein are available under the designations Zeolite A, Zeolite P (B), Zeolite MAP and Zeolite X. In an especially preferred embodiment, the crystalline aluminosilicate ion exchange material has the formula:

$Na_{12}[(AlO_2)_{12}(SiO_2)_{12}].xH_2O$ wherein x is from 20 to 30, especially 27. This material is known as Zeolite A. Dehydrated zeolites (x=0–10) may also be used herein. Preferably, the aluminosilicate has a particle size of 0.1–10 microns in diameter.

Organic detergent builders suitable for the purposes of the present invention include, but are not restricted to, a wide variety of polycarboxylate compounds. As used herein, "polycarboxylate" refers to compounds having a plurality of carboxylate groups, preferably at least 3 carboxylates. Polycarboxylate builder can generally be added to the composition in acid form, but can also be added in the form of a neutralized salt. When utilized in salt form, alkali metals, such as sodium, potassium, and lithium, or alkanolammonium salts are preferred.

Included among the polycarboxylate builders are a variety of categories of useful materials. One important category of polycarboxylate builders encompasses the ether polycarboxylates, including oxydisuccinate, as disclosed in Berg, U.S. Pat. No. 3,128,287, issued Apr. 7, 1964, and Lamberti et al, U.S. Pat. No. 3,635,830, issued Jan. 18, 1972. See also "TMS/TDS" builders of U.S. Pat. No. 4,663,071, issued to Bush et al, on May 5, 1987. Suitable ether polycarboxylates also include cyclic compounds, particularly alicyclic compounds, such as those described in U.S. Pat. Nos. 3,923,679; 3,835,163, 4,158,635; 4,120,874 and 4,102,903.

Other useful detergency builders include the ether hydroxypolycarboxylates, copolymers of maleic anhydride with ethylene or vinyl methyl ether, 1,3,5-trihydroxy benzene-2,4,6-trisulphonic acid, and carboxymethyloxysuccinic acid, the various alkali metal, ammonium and substituted ammonium salts of polyacetic acids such as ethylenediamine tetraacetic acid and nitrilotriacetic acid, as well as polycarboxylates such as mellitic acid, pyromellitic, succinic acid, oxydisuccinic acid, polymaleic acid, benzene 1,3,5-tricarboxylic acid, carboxymethyloxysuccinic acid, and soluble salts thereof.

Citrate builders, e.g., citric acid and soluble salts thereof (particularly sodium salt), are polycarboxylate builders of particular importance for heavy duty liquid detergent formulations due to their availability from renewable resources and their biodegradability. Citrates can also be used in granular compositions, especially in combination with zeolite and/or layered silicate builders. Oxydisuccinates are also especially useful in such compositions and combinations.

Also suitable in the detergent compositions of the present invention are the 3,3-dicarboxy-oxa-1,6-hexanedioates and the related compounds disclosed in U.S. Pat. No. 4,566,984, Bush, issued Jan. 28, 1986. Useful succinic acid builders include the $C_5$–$C_{20}$ alkyl and alkenyl succinic acids and salts thereof. A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in EP 0,200,263.

Other suitable polycarboxylates are disclosed in U.S. Pat. Nos. 4,144,226 and in 3,308,067. See also U.S. Pat. No. 3,723,322.

Fatty acids, e.g., $C_{12}$–$C_{18}$ monocarboxylic acids such as oleic acid and/or its salts, can also be incorporated into the compositions alone, or in combination with the aforesaid builders, especially citrate and/or the succinate builders, to provide additional builder activity. Such use of fatty acids will generally result in a diminution of sudsing, which should be taken into account by the formulator.

In situations where phosphorus-based builders can be used, and especially in the formulation of bars used for hand-laundering operations, the various alkali metal phosphates such as the well-known sodium tripolyphosphates, sodium pyrophosphate and sodium orthophosphate can be used. Phosphonate builders such as ethane-1-hydroxy-1,1-diphosphonate and other known phosphonates (see, for example, U.S. Pat. Nos. 3,159,581; 3,213,030; 3,422,021; 3,400,148 and 3,422,137) can also be used.

Bleaching Compounds—Bleaching Agents and Bleach Activators

The detergent compositions herein may optionally contain bleaching agents or bleaching compositions containing a bleaching agent and one or more bleach activators. When present, bleaching agents will typically be at levels of from 1% to 30%, more typically from 5% to 20%, of the detergent composition, especially for fabric laundering. If present, the amount of bleach activators will typically be from 0.1% to 60%, more typically from 0.5% to 40% of the bleaching composition comprising the bleaching agent-plus-bleach activator.

The bleaching agents used herein can be any of the bleaching agents useful for detergent compositions in textile cleaning or other cleaning purposes that are now known or become known. These include oxygen bleaches as well as other bleaching agents. Perborate bleaches, e.g., sodium perborate (e.g., mono- or tetra-hydrate) can be used herein.

Another category of bleaching agent that can be used without restriction encompasses percarboxylic acid bleaching agents and salts thereof. Suitable examples of this class of agents include magnesium monoperoxyphthalate hexahydrate, the magnesium salt of metachloro perbenzoic acid, 4-nonylamino-4-oxoperoxybutyric acid and diperoxydodecanedioic acid. Such bleaching agents are disclosed in U.S. Pat. Nos. 4,483,781, 740,446, EP 0,133,354, and U.S. Pat. No. 4,412,934. Highly preferred bleaching agents also include 6-nonylamino-6-oxoperoxycaproic acid as described in U.S. Pat. No. 4,634,551.

Peroxygen bleaching agents can also be used. Suitable peroxygen bleaching compounds include sodium carbonate peroxyhydrate and equivalent "percarbonate" bleaches, sodium pyrophosphate peroxyhydrate, urea peroxyhydrate, and sodium peroxide. Persulfate bleach (e.g., OXONE, manufactured commercially by DuPont) can also be used.

A preferred percarbonate bleach comprises dry particles having an average particle size in the range from 500 micrometers to 1,000 micrometers, not more than 10% by weight of said particles being smaller than 200 micrometers and not more than 10% by weight of said particles being larger than 1,250 micrometers.

Optionally, the percarbonate can be coated with silicate, borate or water-soluble surfactants. Percarbonate is available from various commercial sources such as FMC, Solvay and Tokai Denka.

Mixtures of bleaching agents can also be used.

Peroxygen bleaching agents, the perborates, the percarbonates, etc., are preferably combined with bleach activators, which lead to the in situ production in aqueous solution (i.e., during the washing process) of the peroxy acid corresponding to the bleach activator. Various non-limiting examples of activators are disclosed in U.S. Pat. Nos. 4,915,854, and 4,412,934. The nonanoyloxybenzene sulfonate (NOBS), 3,5,5-tri-methyl hexanoyl oxybenzene sulfonate (ISONOBS) and tetraacetyl ethylene diamine (TAED) activators are typical, and mixtures thereof can also be used. See also U.S. Pat. No. 4,634,551 for other typical bleaches and activators useful herein. Highly preferred amido-derived bleach activators are those of the formulae:

$$R^1N(R^5)C(O)R^2C(O)L$$

or $$R^1C(O)N(R^5)R^2C(O)L$$

where in $R^1$ is an alkyl group containing from 6 to 12 carbon atoms, $R^2$ is an alkylene containing from 1 to 6 carbon atoms, $R^5$ is H or alkyl, aryl, or alkaryl containing from 1 to 10 carbon atoms, and L is any suitable leaving group. A leaving group is any group that is displaced from the bleach activator as a consequence of the nucleophilic attack on the bleach activator by the perhydrolysis anion. A preferred leaving group is phenyl sulfonate.

Preferred examples of bleach activators of the above formulae include (6-octanamido-caproyl) oxybenzenesulfonate, (6-nonanamidocaproyl)oxybenzene sulfonate, (6-decanamido-caproyl)oxybenzenesulfonate, and mixtures thereof as described in U.S. Pat. No. 4,634,551, incorporated herein by reference.

Another class of bleach activators comprises the benzoxazin-type activators disclosed by Hodge et al in U.S. Pat. No. 4,966,723. A highly preferred activator of the benzoxazin-type is:

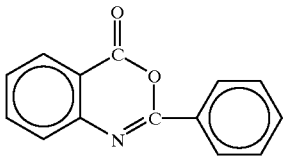

Still another class of preferred bleach activators includes the acyl lactam activators, especially acyl caprolactams and acyl valerolactams of the formulae:

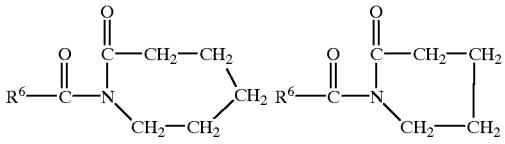

wherein $R^6$ is H or an alkyl, aryl, alkoxyaryl, or alkaryl group containing from 1 to 12 carbon atoms. Highly preferred lactam activators include benzoyl caprolactam, octanoyl caprolactam, 3,5,5-trimethylhexanoyl caprolactam, nonanoyl caprolactam, decanoyl caprolactam, undecenoyl caprolactam, benzoyl valerolactam, octanoyl valerolactam, decanoyl valerolactam, undecenoyl valerolactam, nonanoyl valerolactam, 3,5,5-trimethylhexanoyl valerolactam and mixtures thereof. See also U.S. Pat. No. 4,545,784, issued to Sanderson, Oct. 8, 1985, incorporated herein by reference, which discloses acyl caprolactams, including benzoyl caprolactam, adsorbed into sodium perborate.

Bleaching agents other than oxygen bleaching agents are also known in the art and can be utilized herein. One type of non-oxygen bleaching agent of particular interest includes photoactivated bleaching agents such as the sulfonated zinc and/or aluminum phthalocyanines. See U.S. Pat. No. 4,033,718, issued Jul. 5, 1977 to Holcombe et al. If used, detergent compositions will typically contain from 0.025% to 1.25%, by weight, of such bleaches, especially sulfonate zinc phthalocyanine.

If desired, the bleaching compounds can be catalyzed by means of a manganese compound. Such compounds are well-known in the art and include, for example, the manganese-based catalysts disclosed in U.S. Pat. Nos. 5,246,621, 5,244,594; 5,194,416; 5,114,606; and EP 549,271A1, 549,272A1, 544,440A2, and 544,490A1; Preferred examples of these catalysts include $Mn^{IV}_2(u\text{-}O)_3$(1,4,7-trimethyl-1,4,7-triazacyclononane)$_2(PF_6)_2$, $Mn^{III}_2$ $(u\text{-}O)_1(u\text{-}OAC)_2$(1,4,7-trimethyl-1,4,7-triazacyclononane)$_2$-$(ClO_4)_2$, $Mn^{IV}_4(u\text{-}O)_6$(1,4,7-triazacyclononane)$_4(ClO_4)_4$, $Mn^{III}_{Mn^{IV}_4}$ $(u\text{-}O)_1(u\text{-}OAc)_2$-(1,4,7-trimethyl-1,4,7-triazacyclononane)$_2$ $(ClO_4)_3$, $Mn^{IV}$(1,4,7-trimethyl-1,4,7-triazacyclononane)-$(OCH_3)_3(PF_6)$, and mixtures thereof. Other metal-based bleach catalysts include those disclosed in U.S. Pat. Nos. 4,430,243 and 5,114,611. The use of manganese with various complex ligands to enhance bleaching is also reported in the following U.S. Pat. Nod.: 4,728,455; 5,284,944; 5,246,612; 5,256,779; 5,280,117; 5,274,147; 5,153,161; and 5,227,084.

As a practical matter, and not by way of limitation, the compositions and processes herein can be adjusted to provide on the order of at least one part per ten million of the active bleach catalyst species in the aqueous washing liquor, and will preferably provide from 0.1 ppm to 700 ppm, more preferably from 1 ppm to 500 ppm, of the catalyst species in the laundry liquor.

Other preferred optional ingredients include enzyme stabilisers, polymeric soil release agents, materials effective for inhibiting the transfer of dyes from one fabric to another during the cleaning process (i.e., dye transfer inhibiting agents), polymeric dispersing agents, suds suppressors, optical brighteners or other brightening or whitening agents, chelating agents, fabric softening clay, anti-static agents, other active ingredients, carriers, hydrotropes, processing aids, dyes or pigments, solvents for liquid formulations and solid fillers for bar compositions.

Liquid detergent compositions can contain water and other solvents as carriers. Low molecular weight primary or secondary alcohols. exemplified by methanol, ethanol, propanol, and isopropanol are suitable. Monohydric alcohols are preferred for solubilizing surfactant, but polyols such as those containing from 2 to 6 carbon atoms and from 2 to 6 hydroxy groups (e.g., 1,3-propanediol, ethylene glycol, glycerine, and 1,2-propanediol) can also be used. The compositions may contain from 5% to 90%, typically 10% to 50% of such carriers.

Granular detergents can be prepared, for example, by spray-drying (final product density 520 g/l) or agglomerating (final product density above 600 g/l) the Base Granule. The remaining dry ingredients can then be admixed in granular or powder form with the Base Granule, for example in a rotary mixing drum, and the liquid ingredients (e.g., nonionic surfactant and perfume) can be sprayed on.

The detergent compositions herein will preferably be formulated such that, during use in aqueous cleaning operations, the wash water will have a pH of between 6.5 and 11, preferably between 7.5 and 10.5. Laundry products are typically at pH 9–11. Techniques for controlling pH at recommended usage levels include the use of buffers, alkalis, acids, etc., and are well-known to those skilled in the art.

Method of Use

Also provided herein is a method for providing a delayed release of an active alcohol which comprises the step of contacting the material to be treated with an aqueous medium comprising a compound or composition of the invention.

By "material", it is meant any surface onto which the compound can deposit. Typical examples of such material are fabrics, hard surfaces such as dishware, floors, bathrooms, toilet, kitchen and other surfaces in need of a delayed release of an active alcohol.

By "delayed release" is meant release of the active component (e.g perfume) over a longer period of time than by the use of the active (e.g., perfume) itself.

In the composition examples, the abbreviated component identifications have the following meanings:

| | |
|---|---|
| DEQA | Di-(tallowyl-oxy-ethyl) dimethyl ammonium chloride |
| DTDMAC | Ditallow dimethylammonium chloride |
| Fatty acid | Stearic acid of IV = 0 |
| Electrolyte | Calcium chloride |
| PEG | Polyethylene Glycol 4000 |
| Carezyme | cellulytic enzyme sold by NOVO Industries A/S |
| LAS | Sodium linear C12 alkyl benzene sulphonate |
| TAS | Sodium tallow alcohol sulphate |
| XYAS | Sodium $C_{1X}$–$C_{1Y}$ alkyl sulfate |
| XYEZ | A $C_{1X}$–$C_{1Y}$ predominantly linear primary alcohol condensed with an average of Z moles of ethylene oxide |
| Soap | Sodium linear alkyl carboxylate derived from an 80/20 mixture of tallow and a coconut oils. |
| NaSKS-6 | Crystalline layered silicate of formula $\delta$-$Na_2Si_2O_5$ |
| MA/AA | Copolymer of 1:4 maleic/acrylic acid, average molecular weight about 70,000. |
| STPP | Anhydrous sodium tripolyphosphate |
| Zeolite A | Hydrated Sodium Aluminosilicate of formula $Na_{12}(AlO_2SiO_2)_{12}.27H_2O$ having a primary particle size in the range from 1 to 10 micrometers |
| Percarbonate | Anhydrous sodium percarbonate bleach coated with a coating of sodium silicate ($Si_2O$:$Na_2O$ ratio = 2:1) at a weight ratio of percarbonate to sodium silicate of 39:1 |
| PB1 | Anhydrous sodium perborate bleach of nominal formula $NaBO_2.H_2O_2$ |
| PB4 | Sodium perborate tetrahydrate of nominal formula $NaBO_2.3H_2O.H_2O_2$ |
| Protease | Proteolytic enzyme sold under the tradename Savinase by Novo Industries A/S with an activity 13 KNPU/g. |
| Protease # | Proteolytic enzyme sold under the tradename Savinase by Novo Industries A/S with an activity 4 KNPU/g. |
| Amylase | Amylolytic enzyme sold under the tradename Termamyl 60T by Novo Industries A/S with an activity of 300 KNU/g |
| Lipase | Lipolytic enzyme sold under the tradename Lipolase by Novo Industries A/S with an activity of 165 KLU/g |
| CMC | Sodium carboxymethyl cellulose |
| DETPMP | Diethylene triamine penta (Methylene phosphonic acid), marketed by Monsanto under the Tradename Dequest 2060 |
| HEDP | Hydroxy-ethane 1,1 diphosphonic acid |
| SRA (Soil Release Agents) | Sulfobenzoyl end capped esters with oxyethylene oxy and terephthaloyl backbone |
| Sulphate | Anhydrous sodium sulphate |
| Brightener 1 | Disodium 4,4'-bis(2-Sulphostyryl)biphenyl |
| Brightener 2 | Disodium 4,4'-bis(4-anilino-6-morpholino-1.3.5-triazin-2-yl)amino)stilbene-2:2'-disulphonate. |
| Photoactivated bleach | Sulphonated Zinc Phthalocyanine encapsulated in dextrin soluble polymer |
| Silicone antifoam | Polydimethylsiloxane foam controller with Siloxane-oxyalkylene copolymer as dispersing agent with a ratio of said foam controller to said dispersing agent of 10:1 to 100:1. |
| Nonionic | $C_{13}$–$C_{15}$ mixed ethoxylated/propoxylated fatty alcohol with an average degree of ethoxylation of 3.8 and an average degree of propoxylation of 4.5 sold under the tradename Plurafac LF404 by BASF Gmbh (low foaming) |
| Metasilicate | Sodium metasilicate ($SiO_2$:$Na_2O$ ratio = 1.0) |
| Silicate | Amorphous Sodium Silicate ($SiO_2$:$Na_2O$ ratio = 2.0) |

-continued

| | |
|---|---|
| Carbonate | Anhydrous sodium carbonate |
| 480N | Random copolymer of 3:7 acrylic/methacrylic acid, average molecular weight about 3,500 |
| Citrate | Tri-sodium citrate dihydrate |
| TAED | Tetraacetyl ethylene diamine |
| Cationic precursor | Cationic peroxyacid bleach precursor salt of trialkyl ammonium methylene $C_5$-alkyl caprolactam with tosylate |
| BzP | Dibenzoyl peroxide |
| PMT | 1-phenyl-5-mercapto-1,2,3,4-tetrazole |
| Bismuth nitrate | Bismuth nitrate salt |
| Paraffin | Paraffin oil sold under the tradename Winog 70 by Wintershall. |
| BD/MA | Copolymer of butadiene/maleic acid as sold by Polysciences inc under the tradename reference no. 07787 |
| BSA | Amylolytic enzyme sold under the tradename LE17 by Novo Industries A/S (approx 1% enzyme activity) |

Synthesis Example I

Preparation of Dihydromyrcenyl Bromoacetate

Bromoacetyl bromide (0.055 mol, 4.74 ml) was mixed with dichloromethane (80 ml), in a 150 ml conical flask, cooled on a cold water-bath (10–15° C.). To this solution were added dropwise a mixture of dihydromyrcenol (0.055 mol. 9.6 ml), pyridine (0.055 mol, 4.4 ml) in dichloromethane (20 ml), the total addition time being 15–30 minutes. The dropping funnel was fitted with a calcium chloride drying tube. The reaction mixture was left to stirr over the cold water-bath for five hours. Then, the white precipitate of pyridinium chloride was filtered off and the reaction mixture was washed with distiled water (3×150 ml), dried over $MgSO_4$ and the solvent removed under reduced pressure, yielding a dark brown oil which is a mixture of dihydromyrcenyl bromoacetate (70 mole %) and dihydromyrcenol (30 mole %). The dihydromyrcenyl bromoacetate is separated as a colourless oil by distillation under reduce pressure (bp 106° C./3 mm Hg).

The synthesis of other alcoyl bromoacetate such as linalyl bromoacetate, phenoxanyl bromoacetate or geranyl bromoacetate was also made following the above synthesis example by replacing the dihydromyrcenol by the required alcohol, i.e. linalool, phenoxyethanol, or geraniol. For primary and tertiary alcohols the yield under such conditions are generally greater than 95%.

Synthesis Example II

Preparation of Linalyl Chloroacetate a) From Chloroacetyl Chloride

Chloroacetyl chloride (0.04 mol, 3.2 ml) was mixed with dry toluene (25 ml), in a 150 ml conical flask. To this solution was added dropwise a mixture of linalool (0.04 mol, 7.2 ml), pyridine (0.04 mol, 3.2 ml) in dry toluene (10 ml), the total addition time being about 15–30 minutes. The dropping funnel was fitted with a calcium chloride drying tube. The reaction mixture was left to stir at 50° C. for 16 hours. Then, the white precipitate of pyridinium chloride was filtered off and the dark solution recovered was washed with a 5% solution of sodium hydrogen carbonate (60 ml), distilled water (2×60 ml), dried over $MgSO_4$ and the solvent removed under reduced pressure, yielding a dark brown oil which was analysed by 1H/13C NMR and GC/MS as being a mixture of linalyl chloroacetate (75 mole %) and linalool (25 mole %). The linalyl chloroacetate is separated as a colourless oil by distillation under reduce pressure (bp 104° C./2 mm Hg).

b) From Chloroacetic Anhydride

The above experiment was repeated except that chloroacetic anhydride (6.83 g, 0.04 mol) was used instead of chloroacetyl chloride. The solvent used was dichloromethane rather than toluene. The conditions of reaction were 2 h30 at room temperature and the reaction yielded a slightly brown oil which is about 95% pure linalyl chloroacetate. This can be purified even further by distillation under reduced pressure as above.

Synthesis Example III

Preparation of PEI 1800 $E_{0.5}$

The ethoxylation is conducted in a 2 gallon stirred stainless steel autoclave equipped for temperature measurement and control, pressure measurement, vacuum and inert gas purging, sampling, and for introduction of ethylene oxide as a liquid. A ~20 lb. net cylinder of ethylene oxide (ARC) is set up to deliver ethylene oxide as a liquid by a pump to the autoclave with the cylinder placed on a scale so that the weight change of the cylinder could be monitored.

A 750 g portion of polyethyleneimine (PEI) (Nippon Shokubai, Epomin SP-018 having a listed average molecular weight of 1800 equating to about 0.417 moles of polymer and 17.4 moles of nitrogen functions) is added to the autoclave. The autoclave is then sealed and purged of air (by applying vacuum to minus 28" Hg followed by pressurization with nitrogen to 250 psia, then venting to atmospheric pressure). The autoclave contents are heated to 130° C. while applying vacuum. After about one hour, the autoclave is charged with nitrogen to about 250 psia while cooling the autoclave to about 105° C. Ethylene oxide is then added to the autoclave incrementally over time while closely monitoring the autoclave pressure, temperature, and ethylene oxide flow rate. The ethylene oxide pump is turned off and cooling is applied to limit any temperature increase resulting from any reaction exotherm. The temperature is maintained between 100° C. and 110° C. while the total pressure is allowed to gradually increase during the course of the reaction. After a total of 375 grams of ethylene oxide has been charged to the autoclave (roughly equivalent to half a mole ethylene oxide per mole PEI nitrogen function), the temperature is increased to 110° C. and the autoclave is allowed to stir for an additional hour. At this point, vacuum is applied to remove any residual unreacted ethylene oxide.

The reaction mixture is then deodorized by passing about 100 cu. ft. of inert gas (argon or nitrogen) through a gas dispersion frit and through the reaction mixture while agitating and heating the mixture to 130° C.

The final reaction product is cooled slightly and collected in glass containers purged with nitrogen.

The same process as for PEI 1800 $E_{0.5}$ can be used but using other PEI such as PEI 1200 or PEI 600.

Synthesis Example IV

Preparation of PEI 600 $E_{0.25}$

The ethoxylation is conducted in a 2 gallon stirred stainless steel autoclave equipped for temperature measurement and control, pressure measurement, vacuum and inert gas purging, sampling, and for introduction of ethylene oxide as a liquid. A ~20 lb. net cylinder of ethylene oxide (ARC) is set up to deliver ethylene oxide as a liquid by a pump to the autoclave with the cylinder placed on a scale so that the weight change of the cylinder could be monitored.

A 750 g portion of polyethyleneimine (PEI) (having a listed average molecular weight of 600 equating to about 1.25 moles of polymer and 17.4 moles of nitrogen functions) is added to the autoclave. The autoclave is then sealed and purged of air (by applying vacuum to minus 28" Hg followed by pressurization with nitrogen to 250 psia, then venting to atmospheric pressure). The autoclave contents are heated to 130° C. while applying vacuum. After about one hour, the autoclave is charged with nitrogen to about 250 psia while cooling the autoclave to about 105° C. Ethylene oxide is then added to the autoclave incrementally over time while closely monitoring the autoclave pressure, temperature, and ethylene oxide flow rate. The ethylene oxide pump is turned off and cooling is applied to limit any temperature increase resulting from any reaction exotherm. The temperature is maintained between 100° C. and 110° C. while the total pressure is allowed to gradually increase during the course of the reaction. After a total of 187.5 grams of ethylene oxide has been charged to the autoclave (roughly equivalent to a quarter of a mole ethylene oxide per mole PEI nitrogen function), the temperature is increased to 110° C. and the autoclave is allowed to stir for an additional hour. At this point, vacuum is applied to remove any residual unreacted ethylene oxide.

The reaction mixture is then deodorized by passing about 100 cu. ft. of inert gas (argon or nitrogen) through a gas dispersion frit and through the reaction mixture while agitating and heating the mixture to 130° C.

The final reaction product is cooled slightly and collected in glass containers purged with nitrogen.

Synthesis Example V

Preparation of Polyglycine Dihydromyrcenyl Ester Based on PEI 1200

Polyethylenimine MW 1200 (Highly branched) commercially available from Polyscience (54.5 g, 1.3 mol of repeat unit) is stirred in hot ethyl acetate (500 ml) until it totally dissolves then sodium carbonate anhydrous (70 g, 0.65 mol) is added, followed by dihydromyrcenyl bromoacetate (90.1 g, 0.325 mol). The reaction mixture is stirred at 50–60° C. for 14 hours, after which an NMR check shows that the reaction seems completed. The sodium carbonate is filtered off and the ethyl acetate is then removed under vacuum. Diethyl ether (200 ml) is then added and the reaction mixture is stored at 4° C. for a few hours before being filtered. Removal of the diethyl ether under vacuum yields the polyglycine dihydromyrcenyl ester as a dark yellow gum (55.5 g).

The same results were obtained where a polyethyleneimine MW 1800 or 600, instead of polyethyleneimine MW 1200, was used.

Partially quaternised polyglycine dihydromyrcenyl ester can also be prepared by using a partially quaternised polyethylene imine. Method to prepare such partially quaternised polyethylene imine are known in the art and are typically prepared by using polyethylenimine MW 1200 in an excess of alkylating agent such as bromomethyl, chloromethyl or methyl tosylate for at least two days.

Other polyglycine esters of active alcohol are also obtained by replacing the dyhydromyrcenyl bromoacetate by the corresponding bromoacetate of active alcohol such as linalyl bromoacetate, phenoxanyl bromoacetate or geranyl bromoacetate.

Synthesis Example VI

Mixed Hydroxyethylated/methylcarbonyloxygera alkylated PEI

Partially hydroxyethylated PEI MW 1800, E0.5 (9.68 g) is dissolved in 100 ml of hot chloroform before adding sodium carbonate anhydrous (6.36 g, 0.06 mol) and geranyl bromoacetate (8.269, 0.03 mol).

The mixture is stirred at 50° C. for 1 hour and then at room temperature for an extra 3 hours, after which sodium carbonate is removed by filtration. The filtrate is concentrated under vacuum and the brown gum obtained left to cool before adding some diethyl ether (100 ml). In order to remove any unreacted geranyl bromoacetate, the gum is triturated with the ether until it has all been turned into a fine dust. The mixture is then left to stir at room temperature for an hour after which the fine dust is removed by filtration, thoroughly dried under vacuum in a desiccator before being finely ground, yielding 14.1 grams of mixed hydroxyethylated/methylcarbonyoxygeranyl alkylated PEI as a fine light brown dust, which was characterised by $^1$H NMR ($CDCl_3$).

The same results are obtained where a polyethyleneimine (MW 1800) $E_{0.5}$ or (MW600) $E_{0.5}$, instead of polyethyleneimine (MW 1200) $E_{0.5}$, was used.

Other polyglycine esters of active alcohols are also obtained by replacing the geranyl bromoacetate by the corresponding bromoacetate of active alcohol such as linalyl bromoacetate, phenoxanyl bromoacetate or dyhydromyrcenyl bromoacetate.

Synthesis Example VII

Mixed Hydroxyethylated/methylcarbonyloxygeranyl alkylated PEI

Partially hydroxyethylated PEI MW 600, $E_{0.25}$ as made in Synthesis Example IV (10.8 g, equating to about 0.014 mole of polymer and 0.2 mole of nitrogen, a quarter of which have been hydroxyethylated) is mixed in 120 ml of hot ethyl acetate before adding geranyl bromoacetate (13.76 g, 0.05 mol). The mixture is stirred at 50° C. for 24 hours after which the solution is concentrated under vacuum and the brown gum obtained left to cool before adding some diethyl ether (150 ml). In order to remove any unreacted geranyl bromoacetate, the gum is triturated with diethyl ether until it has all been turned into a fine dust. The mixture is then left to stir at room temperature for an hour after which the fine dust is removed by filtration, thoroughly dried under vacuum in a desiccator before being finely ground, yielding 19.5 grams of mixed hydroxyethylated/methylcarbonyoxygeranyl alkylated PEI as a fine light brown dust, which was characterised by $^1$H NMR ($CDCl_3$).

Synthesis Example VIII

Preparation of Polyglycine Linalyl Ester Based on PEI 600

Polyethylenimine MW 600 (Highly branched) (7.5 g, ~0.2 mol of repeat unit) commercially available from Polyscience is stirred in hot ethyl acetate (200 ml) until it totally dissolves then sodium carbonate anhydrous (10.6 g, 0.1 mol) is added, followed by linalyl chloroacetate (11.53 g, 0.05 mol). The reaction mixture is stirred at 50–60° C. for 100 hours, after which an NMR check shows that the reaction seems completed. The sodium carbonate is filtered off, the ethyl acetate is then removed under vacuum. Petroleum ether 40–60° C. (200 ml) is then added and the reaction mixture is stored at 4° C. for a few hours before being filtered. Removal of the petroleum ether 40–60° C. under vacuum yields the polyglycine linalyl ester as a dark yellow gum (13.4 g).

Synthesis Example IX

Preparation of Polypyridinium Betaine Esters

To a suspension of poly(4-vinylpyridine) (10.51 g, 0.1 mol of repeat units) commercially available from Aldrich in hot acetone is added geranyl bromoacetate (13.76 g, 0.05 mol). Then the mixture is refluxed for 24 hours, after which the hot solution is filtered. The solid recovered is then stirred in diethyl ether (100 ml) for 10 minutes, filtered again, washed with diethyl ether and dried under vacuum in a desiccator, yielding a partially alkylated poly(4-vinylpyridine) {poly [4-vinylpyridine/geranyloxycarbonylmethyl(4-vinylpyridinium) bromide]} as a fine white dust (21.2 grams). The various acetone and ether phases contain any unreacted geranyl bromoacetate.

The invention is illustrated in the following non-limiting examples, in which all percentages are on an active weight basis unless otherwise stated.

EXAMPLE 1

The following fabric softening compositions are in accordance with the present invention

| Component | A | B | C | D | E | F |
|---|---|---|---|---|---|---|
| DTDMAC | — | — | — | — | 4.5 | 15.0 |
| DEQA | 2.6 | 2.9 | 18.0 | 19.0 | — | — |
| Fatty acid | 0.3 | — | 1.0 | — | — | — |
| Hydrochloride acid | 0.02 | 0.02 | 0.02 | 0.02 | 0.02 | 0.02 |
| PEG | — | — | 0.6 | 0.6 | — | 0.6 |
| Perfume | 1.0 | 1.0 | 1.0 | 1.0 | 1.0 | 1.0 |
| Silicone antifoam | 0.01 | 0.01 | 0.01 | 0.01 | 0.01 | 0.01 |
| Polymer (*) | 0.4 | 0.6 | 0.8 | 0.8 | 0.6 | 0.8 |
| Electrolyte (ppm) | — | — | 600 | 1200 | — | 1200 |
| Dye (ppm) | 10 | 10 | 50 | 50 | 10 | 50 |
| Carezyme CEVU/g of composition | — | — | — | 50 | — | — |
| Water and minors to balance to 100 | | | | | | |

(*) polymeric ester compound as made in any one of Synthesis Example V to IX.

EXAMPLE 2

The following hard surface cleaning compositions G to L are in accordance with the present invention

| | G | H | I |
|---|---|---|---|
| Dobanol 23-3 ® | 3.20 | 3.20 | 1.28 |
| Lutensol AO30 ® | 4.80 | 4.80 | 1.92 |
| Dobanol C7-11EO6 ® | 8.0 | 8.0 | 3.20 |
| Topped Palm Kernal Fatty acid, Na salt | 0.80 | 0.80 | 0.40 |
| C8 Alkyl sulphate, Na salt | 2.0 | 2.0 | 0.8 |
| Parafin sulphonate, Na salt | 3.0 | 3.0 | 1.20 |
| Cumene sulphonate, Na salt | 3.0 | 3.0 | 1.20 |
| Perfume | 0.8 | 0.8 | 0.6 |
| Branched alcohol, Isofol 16 ® | — | — | 0.30 |
| Polymer (*) | 1.86 | 2.49 | 0.6 |
| NaOH up to | pH 10 | pH 10 | pH 10 |
| Water and Minors up to 100% | | | |

(*) polymeric ester compound as made in any one of Synthesis Example V to IX.

Processing of composition G and H were made by adding all materials and mixing together with the polymeric compound of the invention.

Processing of composition I was made by addition of all components to a premix of the polymeric compound of the invention and perfume followed by addition of the remaining water. Alternatively, all materials except the polymeric compound of the invention and perfume were mixed, followed by the addition of said polymeric compound and heating to 70° C. for a short period of time and the mixture is thereafter left to cool at ambient temperature (20° C.). Once the mixture was cooled to ambient temperature, the perfume component was added with stirring.

EXAMPLE 3

The following dishwashing machine compositions according to the invention were prepared.

| | J | K | L | M | N | O | P |
|---|---|---|---|---|---|---|---|
| Citrate | 15.0 | 15.0 | 15.0 | 15.0 | 15.0 | 15.0 | — |
| 480N | 6.0 | 6.0 | 6.0 | 6.0 | 6.0 | 6.0 | — |
| Carbonate | 17.5 | 17.5 | 17.5 | 17.5 | 17.5 | 17.5 | — |
| STPP | — | — | — | — | — | — | 38.0 |
| Silicate (as $SiO_2$) | 8.0 | 8.0 | 8.0 | 8.0 | 8.0 | 8.0 | 14.0 |
| Metasilicate (as $SiO_2$) | 1.2 | 1.2 | 1.2 | 1.2 | 1.2 | 1.2 | 2.5 |
| PB1 (AvO) | 1.2 | 1.2 | 1.5 | 1.5 | 1.5 | 2.2 | 1.2 |
| TAED | 2.2 | 2.2 | 2.2 | — | — | 2.2 | 2.2 |
| BzP | — | — | — | 0.8 | — | — | — |
| Cationic precursor | — | — | — | — | 3.3 | — | — |
| Paraffin | 0.5 | 0.5 | 0.5 | 0.5 | 0.5 | 0.5 | 0.5 |
| Bismuth nitrate | — | 0.2 | 0.2 | 0.2 | 0.3 | 0.4 | 0.2 |
| BD/MA | — | — | — | — | — | — | 0.5 |
| PMT | — | — | — | — | — | — | 0.5 |
| Protease | 0.04 | 0.04 | 0.04 | 0.04 | 0.04 | 0.04 | 0.04 |
| Amylase | 0.03 | 0.03 | 0.03 | 0.03 | 0.03 | 0.03 | — |
| BSA | — | — | — | — | — | 0.03 | |
| DETPMP | 0.13 | 0.13 | 0.13 | 0.13 | 0.13 | 0.13 | — |
| HEDP | 1.0 | 1.0 | 1.0 | 1.0 | 1.0 | 1.0 | — |
| Nonionic | 2.0 | 2.0 | 2.0 | 2.0 | 2.0 | 2.0 | 1.5 |
| Polymer (*) | 0.5 | 0.5 | 0.5 | 1.86 | 1.86 | 1.86 | 1.86 |
| Sulphate ,1 misc inc Moisture to balance | 23.0 | 22.8 | 22.4 | 22.7 | 22.2 | 21.5 | 0.3 |

(*) polymeric ester compound as made in any one of Synthesis Example V to I

EXAMPLE 4

The following laundry compositions according to the invention were prepared.

| | Q | R | S |
|---|---|---|---|
| Blown Powder | | | |
| STPP | 24.0 | — | 24.0 |
| Zeolite A | — | 24.0 | — |
| Sulphate | 9.0 | 6.0 | 13.0 |
| MA/AA | 2.0 | 4.0 | 2.0 |
| LAS | 6.0 | 8.0 | 11.0 |
| TAS | 2.0 | — | — |
| Silicate | 7.0 | 3.0 | 3.0 |
| CMC | 1.0 | 1.0 | 0.5 |
| Brightener 2 | 0.2 | 0.2 | 0.2 |
| Soap | 1.0 | 1.0 | 1.0 |
| DETPMP | 0.4 | 0.4 | 0.2 |
| Spray On | | | |
| 45E7 | 2.5 | 2.5 | 2.0 |
| 25E3 | 2.5 | 2.5 | 2.0 |
| Silicone antifoam | 0.3 | 0.3 | 0.3 |
| Perfume | 0.3 | 0.3 | 0.3 |
| Polymer (*) | 1.86 | 0.5 | 1.86 |
| Dry additives | | | |
| Carbonate | 6.0 | 13.0 | 15.0 |
| PB4 | 18.0 | 18.0 | 10 |
| PB1 | 4.0 | 4.0 | — |
| TAED | 3.0 | 3.0 | 1.0 |
| Photoactivated bleach | 0.02% | 0.02% | 0.02% |
| Protease # | 1.0 | 1.0 | 1.0 |
| Lipolase | 0.4 | 0.4 | 0.4 |
| Termamyl | 0.25 | 0.30 | 0.15 |
| Sulphate | 3.0 | 3.0 | 5.0 |
| Balance (Moisture & Miscellaneous) | 100.0 | 100.0 | 100.0 |

(*) polymeric ester compound as made in any one of Synthesis Example V to I

What is claimed is:

1. A laundry detergent composition comprising:

a) from 0.01% to 10% by weight, of a polyvinylpyrrolidone/polyvinylimidazole polymer which comprises at least one nitrogen atom, wherein at least one of the nitrogen atoms is linked to ester group of the formula:

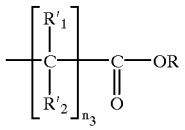

wherein —OR is derived from an active alcohol; each $R'_1$ and $R'_2$ is independently selected from the group consisting of hydrogen, hydroxyl, alkyl, aryl, alkylaryl; $n_3$ is an integer from 1 to 3;

b) from 1% to 55% by weight, of a surfactant; and c) the balance carriers and adjunct ingredients.

2. A composition according to claim 1 wherein —OR is derived from a perfume alcohol, said alcohol is selected form the group consisting of 2-phenoxyethanol, phenylethyl alcohol, geraniol, citronellol, 3-methyl-5-phenyl-1-pentanol, 2,4-dimethyl-3-cyclohexene-1-methanol, linalool, tetrahydrolinalool, 1,2-dihydromyrcenol, hydroxycitronellal, famesol, menthol, eugenol, vanillin, cis-3-hexenol, terpineol, and mixtures thereof.

3. A composition according to claim 1 wherein said adjunct ingredients are selected from the group consisting of enzymes, builders, bleaching agents, bleach boosters, bleach activators, and mixtures thereof.

4. A hard surface cleaning composition comprising:

a) from 0.01% to 10% by weight, of a polyvinylpyrrolidone/polyvinylimidazole polymer which comprises at least one nitrogen atom, wherein at least one of the nitrogen atoms is linked to an ester group of the formula;

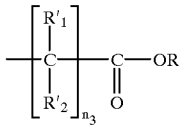

wherein —OR is derived from an active alcohol; each $R'_1$, and $R'_2$ is independently selected from the group consisting of hydrogen, hydroxyl, alkyl, aryl, alkylaryl; $n_3$ is an integer from 1 to 3;

b) from 1% to 55% by weight, of a surfactant; and c) the balance carriers and adjunct ingredients.

5. A composition according to claim 4 wherein —OR is derived from a perfume alcohol, said alcohol is selected form the group consisting of 2-phenoxyethanol, phenylethyl alcohol, geraniol, citronellol, 3-methyl-5phenyl-1-pentanol, 2,4-dimethyl-3cyclohexene-1-methanol, linalool, tetrahydrolinalool, 1,2dihydromyrcenol, hydroxycitronellal, farnesol, menthol, eugenol, vanillin, cis-3-hexenol, terpineol, and mixtures thereof.

6. A composition according to claim 4 wherein said adjunct ingredients are selected from the group consisting of enzymes, builders, bleaching agents, bleach boosters, bleach activators, and mixtures thereof.

* * * * *